United States Patent [19]

Lofquist, Jr.

[11] Patent Number: 4,738,598

[45] Date of Patent: Apr. 19, 1988

[54] METERING PUMP WITH ANNULAR ELEMENTS

[76] Inventor: Alden A. Lofquist, Jr., 10609 Farragut Hills Blvd., Knoxville, Tenn. 37922

[21] Appl. No.: 871,695

[22] Filed: Jun. 6, 1986

Related U.S. Application Data

[63] Continuation-in-part of Ser. No. 787,499, Oct. 15, 1985, Pat. No. 4,637,784.

[51] Int. Cl.[4] ..... F04B 19/14

[52] U.S. Cl. ..... 417/320

[58] Field of Search ..... 417/320; 418/4; 415/5; 416/7; 91/151; 92/89, 90, 93; 222/365, 371

[56] References Cited

U.S. PATENT DOCUMENTS

| | | | |
|---|---|---|---|
| 872,423 | 12/1907 | Hodell | 417/320 |
| 882,576 | 3/1908 | Murray | 91/151 |
| 1,857,896 | 5/1932 | Vellino | 417/320 |
| 3,859,010 | 1/1975 | Lofquist, Jr. | 417/321 |
| 3,924,973 | 12/1975 | Lofquist, Jr. | 417/320 |

*Primary Examiner*—Leonard E. Smith

*Attorney, Agent, or Firm*—Luedeka, Hodges & Neely

[57] ABSTRACT

An apparatus for pumping fluid includes a pump block having a wall surface defining an elongate passageway. Annular elements are movable in the passageway and include deformable peripheral skirts on their rearward ends dimensioned to sealingly engage the wall surface of the passageway to isolate fluid sections between successive elements. The passageway includes portions of changing cross-sectional area and ports provide fluid flow communication with the portions of changing cross-sectional area. The peripheral skirts of the elements are configured to undergo deformation, rather than direct compression, when moving through the portions of changing cross-sectional area to effect pumping action through the ports. The manner in which the skirts of the elements deform minimizes friction when the elements move through the portions of changing cross-sectional area. Another embodiment is shown which employs nondeformable annular elements.

15 Claims, 5 Drawing Sheets

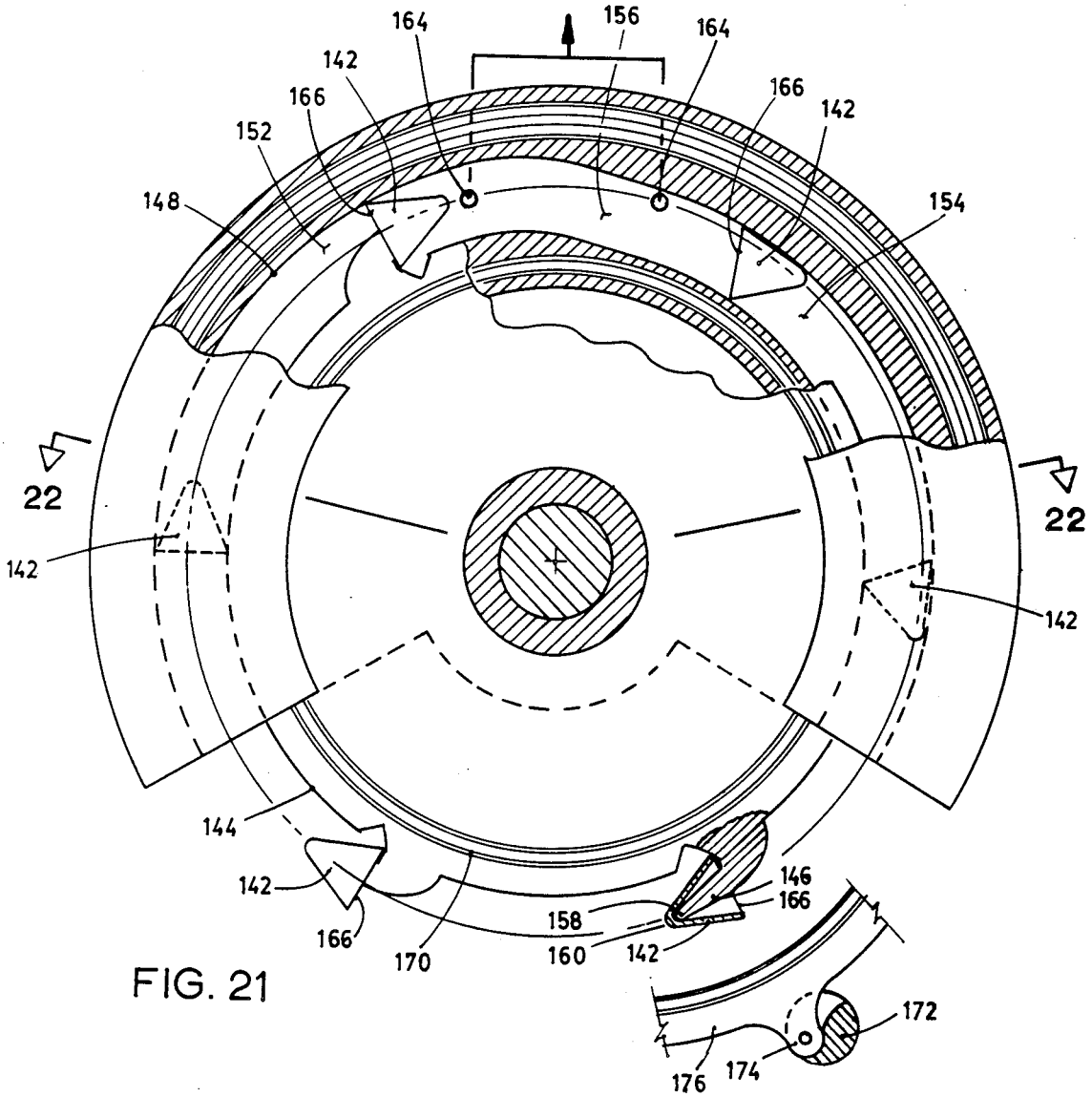
FIG. 21
FIG. 23
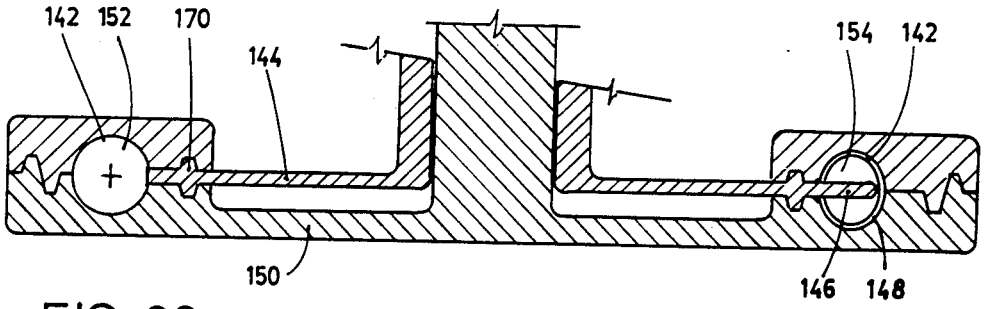
FIG. 22

METERING PUMP WITH ANNULAR ELEMENTS

This application is a continuation-in-part of pending U.S. patent application Ser. No. 787,499 filed on Oct. 15, 1985, now U.S. Pat. No. 4,637,784.

The present invention relates to the design and construction of positive displacement pumps or metering devices generally of the type disclosed in U.S. Pat. Nos. 3,859,010 and 3,924,973 in which a continuous member with annular elements is drawn through aligned bores or passageways of varying cross-sectional areas.

It is a general object of this invention to provide an improved metering pump of the class described.

A further object of the invention is to reduce mechanical friction, improve the sealing relationship between the annular elements and the wall surface defining the passageway, and minimize possible pulsations of the pumped fluid during the pumping process.

A more specific object of the invention is the provision of annular elements that are configured to undergo deformation rather than direct compression or expansion in the process of being drawn from one cross-sectional area to another cross-sectional area of a passageway.

It is also an object of this invention to provide configurations and perimeters of these different cross-sectional areas suited to the designs of the annular elements.

Other objects and advantages of the present invention will be readily appreciated by those of ordinary skill in the art as the same becomes better understood by reference to the following detailed description when considered in conjunction with the accompanying drawings in which:

FIG. 21 is a partial, front elevational view of an embodiment of the invention employing nondeformable elements;

FIG. 22 is a view taken along line 22—22 of the embodiment shown in FIG. 21; and FIG. 23 is a fragmentary view, partially in section, of an alternate form of an annular element for use in the embodiment shown in FIG. 21.

Figure 1:
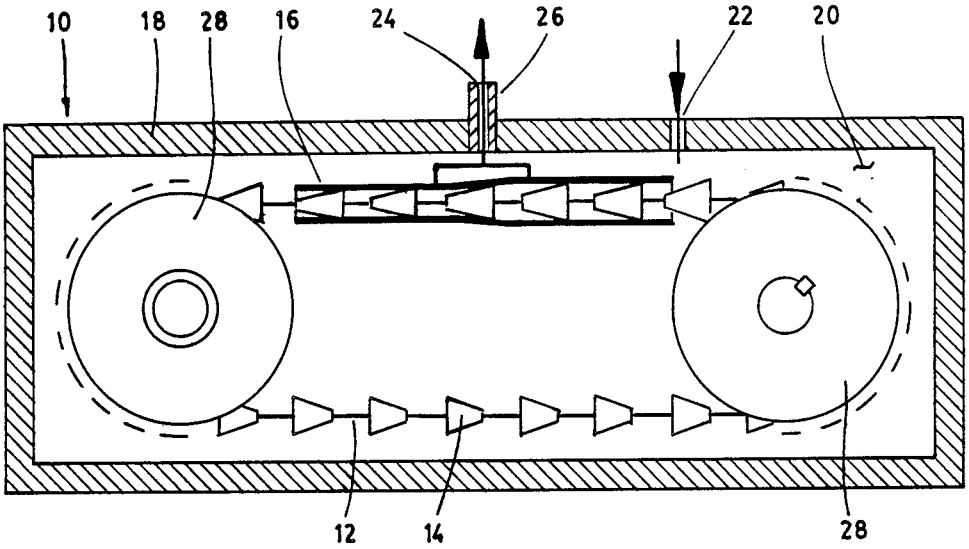
FIG. 1 is a sectional view of a metering pump illustrating a pair of sheaves for supporting and moving a continuous member, to which are attached a plurality of annular elements, through a pump block.
Figure 2:
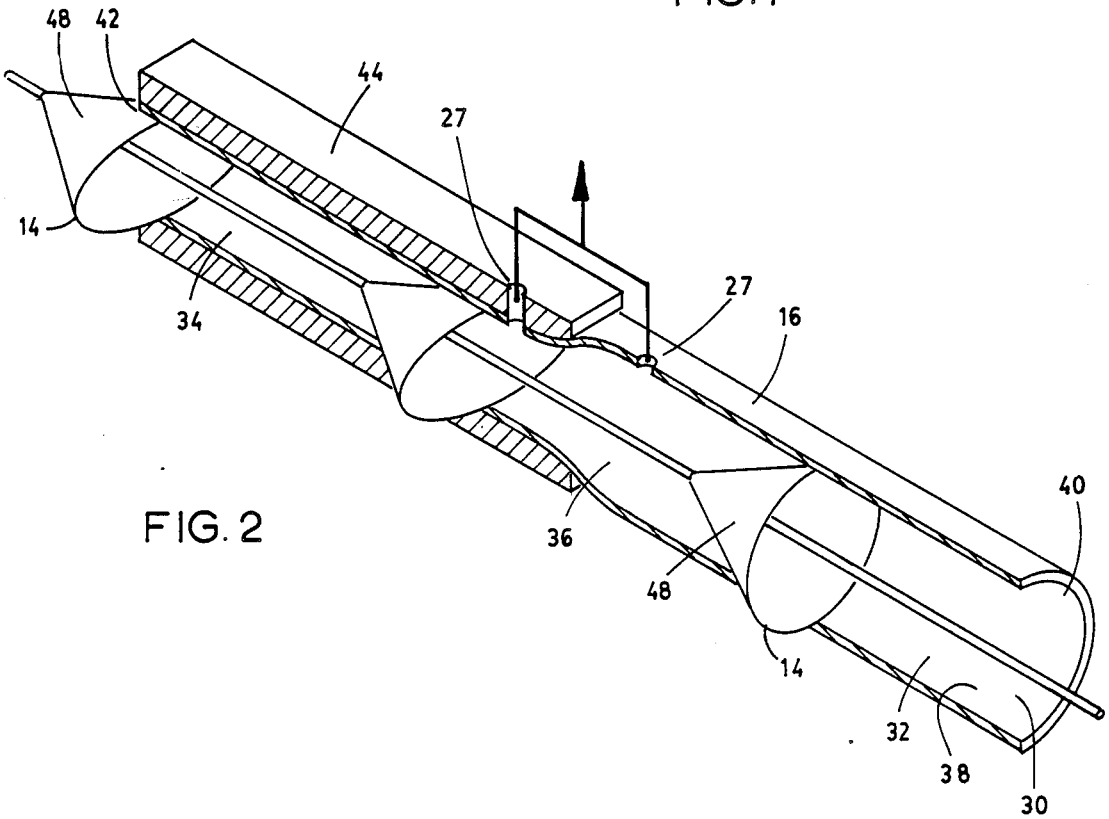
FIG. 2 is a sectional perspective view of a preferred embodiment of the metering apparatus illustrating a pump block with a wall surface defining a passageway having a portion of larger cross-sectional area, a portion of smaller cross-sectional area, and a transitionary area therebetween with a plurality of spaced apart conical elements movable in the passageway.

Referring now to the drawings in which like reference characters refer to like or similar parts throughout the several views, there are shown in FIGS. 1 and 2 various aspects of a metering pump 10 according to a preferred embodiment of the present invention. FIG. 1 broadly illustrates the operative characteristics of the pump 10, an understanding of which will facilitate a better appreciation of the novel aspects of the pump 10 to be described more fully below.

As is shown, a continuous member 12, to which are attached a plurality of spaced apart annular elements 14, is drawn through a generally cylindrical pump block 16 supported within a pump housing 18. Fluid enters a fluid reservoir 20 defined within the enclosure of the housing 18 through an inlet port 22. Fluid within the reservoir 20 is then drawn into the pump block 16 between successive annular elements 14, and is pumped out of the block 16 adjacent a transitionary area therein through a passageway 24 (illustrated diagrammatically) communicating externally of the housing 18 by means of a delivery tube 26.

The continuous member 12 and annular elements 14 are supported and moved through the pump block 16 on a pair of sheaves 28, one of which is driven to induce the desired linear velocity of the annular elements 14.

Figure 7:
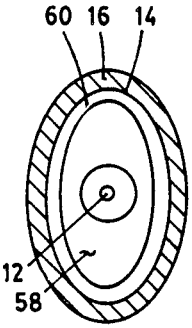
FIG. 7 is an axial projection of the conical element of FIG. 5 illustrating an elliptical cross-sectional area.

Referring now to FIG. 2, an expanded view of the pump block 16 more fully illustrates a preferred manner in which a pumping action is effected through a pair of ports 27 according to this embodiment of the metering pump 10. The annular elements 14 are drawn through a passageway 30 formed in the pump block 16, the pump block 16 having a portion of larger cross-sectional area 32, of smaller cross-sectional area 34, and a transitionary area 36 therebetween. Referring to FIG. 7 in conjunction with FIG. 2, it is seen that the pump block 16 can be shaped in the portion of smaller cross-sectional area 34 so that in cross section it appears as an ellipse, this being the shape illustrated in the perspective view of FIG. 2. The annular elements 14 include a skirt or peripheral surface 48 which is deformed upon passage through the transitionary area 36 to conform to the shape of an inside wall 38 of the pump block 16 defining the passageway 30. The shape of the inside wall 38 changes in the transitionary area 36 in the manner shown, subjecting the annular elements 14 to perimetal deformation instead of direct compression. This greatly reduces frictional losses in the pump.

Depending upon the material and wall thickness, and assuming that the reduction of cross-sectional area is not too great across the transitionary area 36, the cross-sectional perimeter of the pump block 16 remains substantially constant from an inlet open end 40 along the length of the pump block 16 to an outlet open end 42. This is due to the fact that reduction in cross-sectional area according to a preferred form of the present invention is achieved by changing the shape of the wall 38 defining the passageway 30 through deformation of the pump block 16 as shown in FIG. 2, where an appropriately dimensioned pressure pad 44 having a shape generally conforming to the outer surface of the pump block 16 is in contact with the block 16. Clamping means (not shown) are mounted adjacent the pad 44 by suitable means to engage the pad 44 for adjustment of the cross-sectional area. The portion of reduced cross-sectional area 34 is not of circular configuration, but rather of elliptical or flattened circular configuration with dimensions to permit sealing engagement of the annular elements 14 with the wall 38 defining the passageway 30.

Each of the spaced apart annular elements 14 has a deformable peripheral surface or skirt 48 dimensioned to sealingly engage the wall surface 38 defining the passageway 30. Thus, a fluid section is isolated in the space between successive elements 14 when the elements 14 move from the area of the fluid reservoir 20 (FIG. 1) through the inlet open end 40 into the passageway 30. This movement of the elements 14 through the transitionary area 36 deforms the peripheral surface or skirt 48 of the elements 14 to the shape of the wall surface 38, while the perimetal dimension of each annular element 14 remains substantially constant under small deformations, causing the pressure of the fluid section positioned adjacent the transitionary area 36 to change. This effects a pumping action through the ports 27 located adjacent the transitionary area 36. The annular elements 14 are deformed through a change in the shape of their perimeter, rather than through substantial circumferential compression. Thus, stresses are minimized and there is little or no increase in frictional resistance.

Depending on design and dimensions of elements, substantial changes in the shape of the passageway may be made without substantially altering the sealing perimeters of the pumping block and annular elements. For example, a circular passageway may be altered to an elliptical passageway having a minor diameter equal to about 75 percent of the original circular diameter with a change of sealing perimeter of annular elements of only about 1 percent. If the ellipse has a minor diameter equal to about 68 percent of the original diameter the sealing perimeter of the annular elements is reduced by about 1.5 percent.

It is possible to utilize a variety of materials for the pumping block, e.g. metal, fiber reinforced plastics, Teflon, etc. The annular elements include a skirt which can be fabricated from Teflon, other deformable plastics; e.g. polyethylene, polypropylene, Nylon, etc., or fiber reinforced plastics, and even flexible metals. Of course, the deformability of the material from which the skirt is made should be correlated to the degree of perimeter reduction to assure a sealing condition between the skirt and the wall.

The present invention is capable of taking on numerous other forms, some of which are described in detail below.

Figure 3:
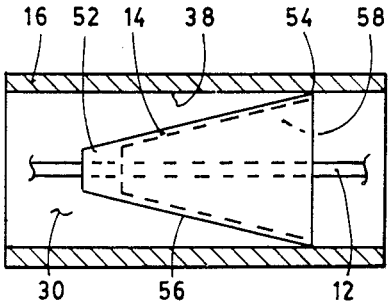
FIG. 3 is a sectional view along the longitudinal axis of a portion of the pump block shown in FIG. 2, illustrating the position of one form of the conical element relative to the wall defining the passageway.

Referring now to FIGS. 3 through 11, examples of the various forms of annular elements 14 suitably adapted for use according to preferred forms of the present invention are shown. In FIG. 3, as in FIGS. 1 and 2, the annular element 14 is shown in the form of a hollow, truncated cone with a forward end 52 attached to the continuous member 12. A rearward or trailing end 54 of the annular element 14 forms a skirt which is spaced longitudinally from the forward end 52. The skirt has a greater perimeter than the perimeter of the forward end 52. A generally conical wall 56 extends generally from the forward end 52 to the rearward end 54 and defines an open-ended hollow portion 58 of the element 14. The hollow portion 58 is provided to more readily permit deformation of the elements. A rearward edge 60 remains substantially the same axial distance from the forward end 52 at all points along the edge 60 when the annular element 14 is deformed into an ellipse with a minor diameter which is over about 80 percent of the original, circular diameter.

The material used to form the annular element 14 is resiliently deformable to change its shape in the manner shown, while of sufficient rigidity to insure a sealing engagement of the rearward edge 60 with the wall 38 defining the passageway 30 as the conical-shaped element 14 moves from the open end 40 of the passageway 30 to the outlet open end 42 of the passageway 30. While one of the preferred forms of the annular element 14 involves the hollow construction discussed above, an effective hollow construction may be obtained by providing a core of spongy material formed of foamed plastic or the like having lower density and greater compressibility in its core portion, with higher density and relatively lower elasticity around the perimeter or skirt portion. Such an element will deform substantially in the manner illustrated in FIGS. 4 and 5. Also, the depth of the hollow portion 58 can be varied according to design criteria to improve the sealing characteristics of the elements 14.

Figure 4:
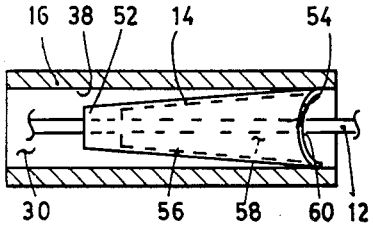
FIG. 4 is a sectional view of the pumping block shown in FIG. 2 illustrating the shape of a deformed annular element in the portion of the passageway with a smaller cross-sectional area along the minor axis of the portion.
Figure 5:
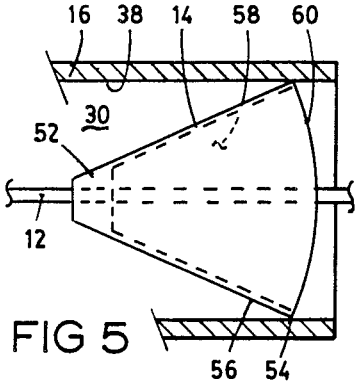
FIG. 5 is a view taken along the major axis of the annular element shown in FIG. 4.

Referring in particular to FIGS. 4 and 5, the manner of a drastic deformation of the annular element 14 in the passageway 30 is illustrated with FIG. 4 representing a sectional view along the minor axis and FIG. 5 representing a sectional view along the major axis. The shapes illustrated in FIGS. 4 and 5 are deformed shapes resulting from passage of the elements 14 through the transitionary area 36 into the portion of smaller cross-sectional area 34 of the pump block 16. As shown in FIG. 5, along the major axis, the shape of the rearward edge 60 of annular element 14 approaches the configuration of the sector of a circle. The base of the rearward edge along its minor axis is shaped as illustrated in FIG. 4. The element 14 assumes this configuration due to the substantially finite distance between the forward end 52 and the rearward edge 60. This causes the sealing point to move axially forward along the element 14. Since the element 14 is normally a cone, the perimeter at the seal is reduced under this drastic deformation and it may be necessary to reduce the perimeter of the passageway 30 somewhat to accomplish a satisfactory seal.

Figure 6:
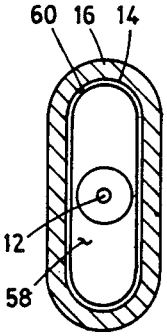
FIG. 6 is an axial projection of the conical element of FIG. 5 illustrating a flattened cross-sectional area.

FIGS. 6 and 7 show alternate cross-sectional views of FIGS. 4 and 5, in which FIG. 6 is a flattened cross-sectional area and FIG. 7 is an elliptical cross-sectional area. The minor diameter or axis of each of these views has previously been established as illustrated in FIGS. 4 and 5. The major diameter or length of major axis of these FIGURES depends on a number of factors including the form that the conical annular element 14 is forced to assume; e.g., FIG. 6 or FIG. 7, or in the alternative, the design and materials of construction of the annular elements 14, all of which affect the deformation characteristics.

Figure 8:
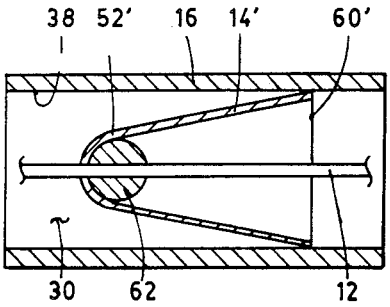
FIG. 8 is a view as shown in FIG. 3 of an alternate form of the conical element illustrating the use of a spherical element attached to the continuous member for supporting the annular element.
Figure 9:
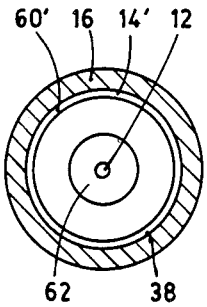
FIG. 9 is an axial projection of the form of the conical element illustrated in FIG. 8.

Referring to FIG. 8, a variation of the form of attachment of annular elements is shown involving attachment to the continuous member 12 of a spherical element or bead 62 with a modified cone-shaped annular element 14' assuming a spherical shape on its forward end 52'. The spherical element 62 can be attached to the continuous member 12 by soldering, swaging or other means, both as a support for the annular element 14' and also as a potential method of joining a finite length of cable into the continuous member 12. FIG. 9 shows a cross-section view of the annular element 14' formed according to the illustration of FIG. 8, where the spherical element 62 can be seen generally concentrically located within the passageway 30 and the rearward edge 60' associated with the modified element 14' sealingly engaging the wall surface 38 defining the passageway 30.

In all of these cases of simple conically-shaped annular elements disclosed thus far, the combinations of major diameters, minor diameters and forms of deformation of the annular elements 14 dictate that the perimeter of the wall 38 defining the passageway 30 of the pumping block 16 in the portion of smaller cross-sectional area 34 is of a smaller dimension than the perimeter of the undeformed conical annular elements 14 when the perimeter is reduced to a point which exceeds the deformability of the skirt material to ensure proper sealing engagement therebetween.

Figure 10:
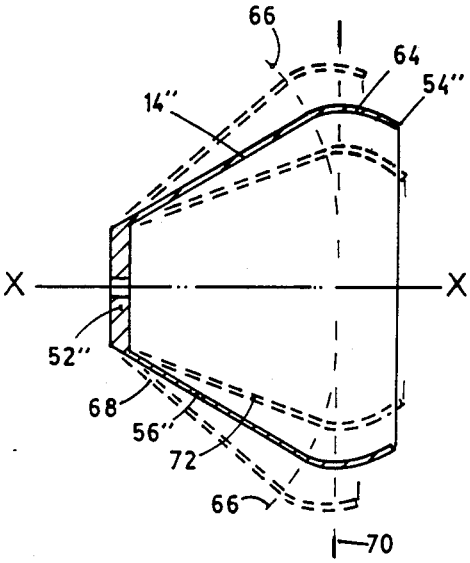
FIG. 10 is a sectional view of an alternate form of the conical element.

According to FIG. 10, a modified annular element 14" is constructed in the form of a truncated cone with a rearward end portion 54" modified to improve the engagement of an altered peripheral surface 64 of the annular element 14" with the wall 38 defining the passageway 30. In this form, the cross-sectional perimeter of the annular element 14" approximates the circumference of the undeformed element 14" when the element 14" is deformed to take an elliptical shape, depending on the design. This is preferably accomplished by configuring the rearward or trailing end portion 54" in the form of the surface of revolution of an involute of a circle as a continuation of the wall portion of the annular element 14", the surface of revolution being taken about the longitudinal axis x—x, thereby providing for maintenance of tangential contact with the wall surface 38 at a fixed axial distance along the annular element 14" regardless of the extent of deformation of the annular element 14". The significance of this modification is that the circumferential dimension of the undeformed annular element 14" approximates the perimeter of the deformed annular element 14", thereby permitting the use of a passageway 30 with a substantially constant perimeter regardless of changes in the cross-sectional area. Thus, considering the generally conical wall 56" as the radius of a circle whose center is the intersection of the wall 56" with the forward end 52", and the deformed locations of the wall 56" forming a circular arc 66, then the addition of the modified rearward end portion 54" which is in the form of the surface of revolution of the involute of a circle would cause the radially outermost part of the peripheral surface 64 at the rearward end portion 54" to be in contact with the wall surface 38 defining the passageway 30 at a substantially constant axial distance along the line of the annular element 14". In the case of the deformed annular element 14" of this configuration, a semi-major radial element 68 would establish tangential contact with the wall surface 38 at a point of contact 70 and a semi-minor radial element 72 would also establish tangential contact with the wall surface 38, also at the axial point of contact 70. Points of contact between the annular elements 14" and the wall surface 38 obviously differ depending upon the design of the annular elements 14", but in all cases provide substantially constant circumference or perimeter regardless of the extent of deformation of the annular elements 14".

The materials and relevant dimensions employed in constructing the annular elements 14 are factors in achieving optimum performance using a hollow cone shape such as that illustrated in FIGS. 3 through 9. While exemplary materials were noted above, the relationship between the material used and the thickness of the conical wall 56 of the elements 14 required to ensure proper sealing engagement should be determined experimentally before dimensions are established in each case.

Figure 12:
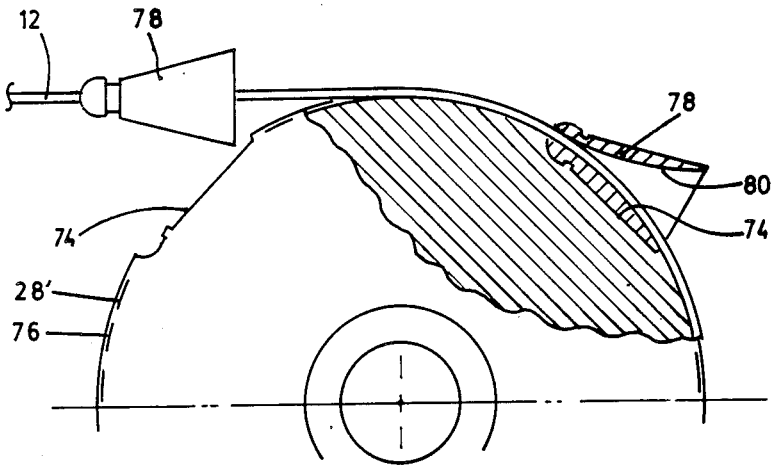
FIG. 12 is a sectional view of a modified sheave containing recesses along its perimeter generally conforming to and supporting the annular elements.

In the use of pumping and metering devices of this type, there is a need to provide a substantially constant linear velocity of the continuous member 12 and annular elements 14 to minimize or eliminate pulsations in the fluid flow from the device 10. In the use of conical annular elements 14, FIG. 12 illustrates a preferred means for achieving a substantially constant linear velocity of the elements 14 through the passageway 30. A sheave 28' is driven at a constant angular velocity and has a series of spaced-apart recesses 74 formed along its radial edge 76. The recesses 74 are spaced to correspond to the spacing of a form of the elements 78 on the continuous member 12 and are dimensioned to correspond to the perimetal surface characteristics of the annular elements 78 being drawn through the passageway 30.

One of the annular elements 78 is shown in cross section in FIG. 12 where it is seen that an inside wall 80 of the element 78 is curved at a constant radius in the axial direction, such curvature matching the curvature of the radial edge 76 of the sheave 28' driving and supporting the continuous member 12 and elements 78. When the annular element 78 is led onto the sheave 28', the element 78 is positioned within the recess 74, the curved wall 80 being positioned between the continuous member 12 and the supporting surface of the recess 74 so that the element 78 will be observed rolling onto the sheave 28' without the continuous member 12 exerting a momentary pull on the successive elements 78, or without the engagement of the element 78 with the sheave 28' producing momentary slack in the continuous member 12. This is because the curved wall 80 causes the continuous member 12 to be led onto the sheave 28' at a constant radius which eliminates pulsations of flow heretofore experienced with sheaves used to draw elements through a pump block. Similar benefits are experienced according to this aspect of the invention when the elements 78 pay off of the sheave 28' where the continuous member 12 lifts from the surface of the sheave 28' with a constant radius.

Figure 11:
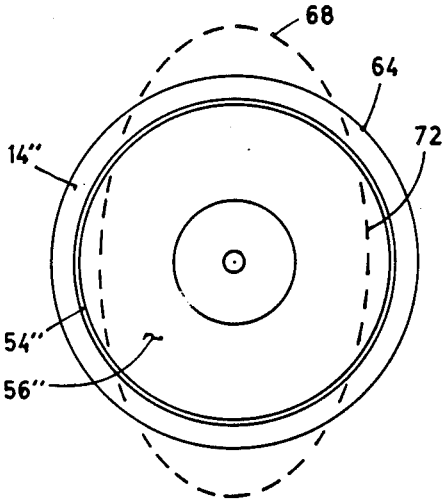
FIG. 11 is an axial view of the conical element shown in FIG. 10 illustrating a deformed shape.
Figure 13:
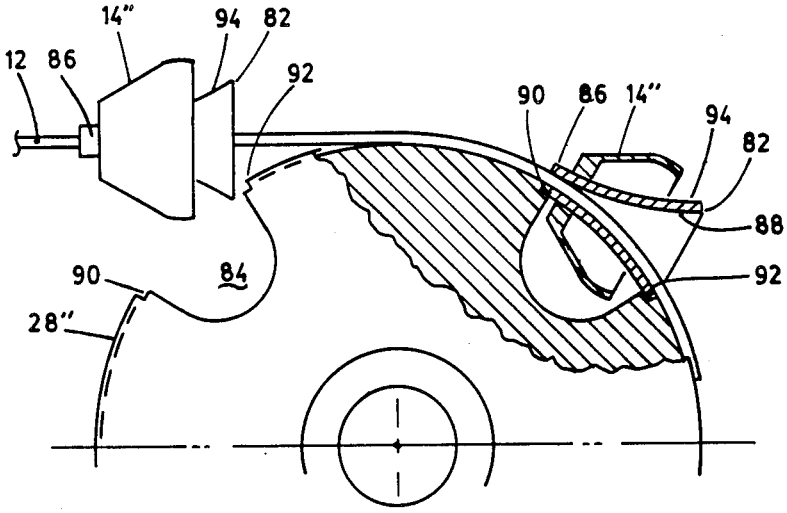
FIG. 13 is a sectional view illustrating another form of the modified sheave for use with annular elements requiring substantial recesses in the sheave perimeter.

In some cases, the material of construction and the design of the annular elements 14 will not permit the interior wall curvature illustrated in FIG. 12. This would be the case, e.g., with a surface of revolution incorporating the involute of a circle as illustrated in FIGS. 10 and 11. There, it is useful to employ a secondary member 82 having a trumpet shape as shown in FIG. 13, which serves as a bridge to support the annular element 14" across a substantial recessed portion 84, a series of which are formed in the radial edge of a further modified sheave 28". The secondary members 82 are dimensioned so they do not contact the wall 38 of the passageway 30 when the conical elements 14" are deformed. In the form of the invention shown in FIG. 13, the secondary member 82 is attached to the continuous member 12 at a forward end 86 similar to the attachment of the annular elements 14 on their forward ends 52 in FIGS. 3 through 5. But in order to have a smooth action, the annular element 14" is attached to the outer surface of the secondary member 82 at the forward end 86 of the secondary member 82. This, in effect, isolates the annular element 14" from contact with the sheave 28" as the annular element 14" is carried on the sheave 28" in the recessed portion 84. Each of the secondary members 82 is formed with a curved wall 88, the radius of curvature of the wall 88 corresponding to the radius of the sheave 28". Forward and rearward laterally oriented ledges 90 and 92, respectively, support the secondary member 82 on the sheave 28". The ledges 90 and 92 are dimensioned to receive part of the forward end 86 of the secondary member 82 extending out from the annular element 14" and part of a rearward portion 94 of the annular elements 14". The ledges 90 and 92 are spaced, one from the other, to correspond to the length of the curvature of the secondary member 82 so that as the secondary member 82 and annular element 14" are led onto the sheave 28", the secondary member 82 rests on the ledges 90 and 92, the thickness of the wall 88 of the secondary member 82 being substantially equal to the radial depth of the ledges 90 and 92. In this manner, substantially constant linear velocity of the annular elements 14" through the passageway 30 is insured, since the continuous member 12 is led onto and paid off of the sheave 28" at a substantially constant radius.

Figure 14:
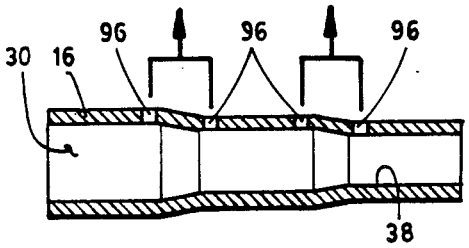
FIG. 14 is a sectional view of a pump block illustrating stepwise reduction of the cross-sectional area.
Figure 15:
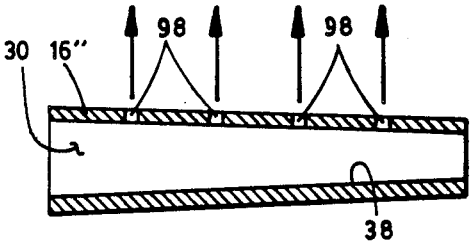
FIG. 15 is a sectional view of a pump block illustrating a smooth transition from larger to smaller cross-sectional area.

FIGS. 14 and 15 illustrate examples of the manner of deforming the pump block 16 to achieve reduction in cross-sectional areas, preferably in a manner which causes the cross-sectional perimeter of the wall 38 defining the passageway 30 to remain substantially constant. FIG. 14 shows a plurality of step-wise reductions in the cross-sectional area in a pump block 16' with a port 96 located adjacent the transitionary area of each change in cross-sectional area. FIG. 15 illustrates a smooth or linear transition from an area of larger cross-sectional area to an area of smaller cross-sectional area in a pump block 16" with ports 98 spaced along the transitionary area. It is to be noted that the fluid discharge characteristics of these two approaches are different.

Figure 16:
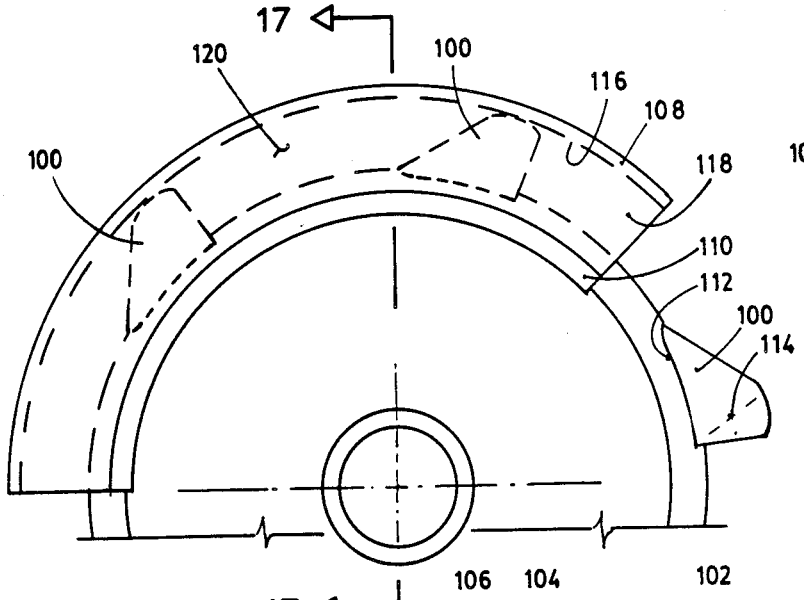
FIG. 16 is a partial, front elevational view of an alternate embodiment of the present invention in which a disk is employed in place of a cable-type continuous member.
Figure 17:
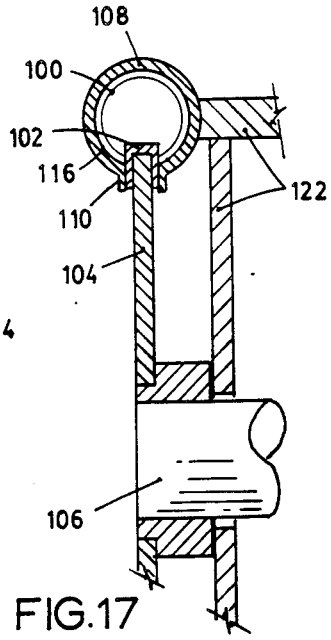
FIG. 17 is a view along line 17—17 of the embodiment shown in FIG. 16.

It has been found that among the numerous modifications of the present invention, the conical elements 14 can be modified according to the form illustrated in FIG. 16 and attached along a ray of the wall of modified conical elements 100 to a continuous ring 102. The ring 102 is driven by a disk 104 mounted on a drive shaft 106 to move the ring 102 and modified annular elements 100 through a tubular pump block 108 of annular configuration resembling the segment of a circle. Fluid sealing rings 110 connected to the tubular pump block 108 provide fluid sealing engagement between the surfaces of the pump block 108 and the continuous ring 102. The modified conical elements 100 are spaced apart as described previously and attached to the curved surface of the continuous ring 102 with a line of attachment 112 curved to suit both the radius of the continuous ring 102 and the curvature of the tubular pump block 108. The configuration of the modified conical elements 100 shown in FIG. 16 is of the general form disclosed in FIGS. 10 and 11 utilizing the concept of the involute of a circle so as to establish a line of tangential contact 114 of the conical elements 100 with a curved wall 116 defining a curved passageway 118 within the pump block 108, thereby establishing a series of fluid sections within the pumping block 108 between successive conical elements 100. The pump block 108 can then be deformed along a portion of its length to define a portion of smaller cross-sectional area and a transitionary area with an outlet port located adjacent the transitionary area generally according to the description above. As shown in FIG. 17, a support structure 122 of some suitable form is provided for the pump block 108 and to provide relative alignment with the continuous ring 102, conical elements 100, and the other components.

Figure 18:
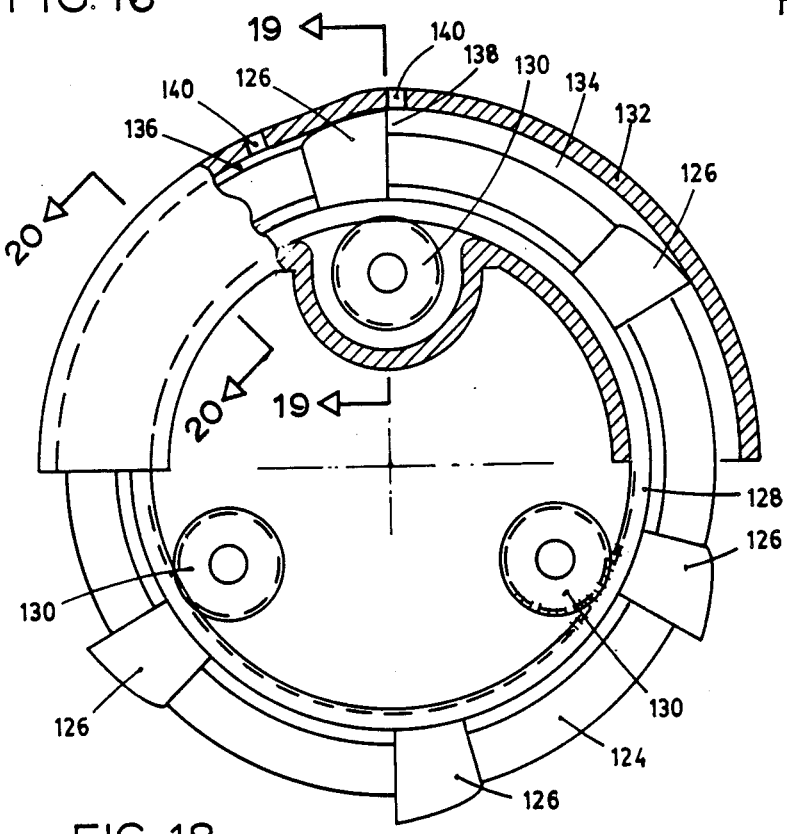
FIG. 18 is a front elevational view, partially in section, of an additional alternate embodiment of the present invention.
Figure 19:
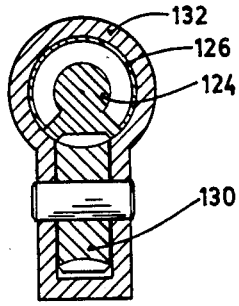
FIG. 19 is a view along line 19—19 of the embodiment of FIG. 18.
Figure 20:
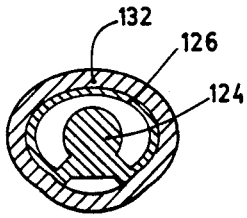
FIG. 20 is a view along line 20—20 in FIG. 18.

One variation of the curved pump block 108 and conical annular elements 100 illustrated in FIG. 16 is shown in FIGS. 18 through 20. In this variation, a rigid, circular continuous member 124 carries additionally modified, somewhat conically-shaped annular elements 126 and is supported in a track 128, and driven by at least three idlers and pinions 130. The rigid continuous member 124 is caused to travel through a pump block 132 which, as shown in FIG. 17, has a portion of larger cross-sectional area 134, a portion of smaller cross-sectional area 136 and a transitionary area 138 therebetween, with outlet ports 140 located adjacent the transitionary area 138 generally on opposite longitudinal ends thereof. The modified annular elements 126 are deformable in the manner described above, with the portion of smaller cross-sectional area 134 of the pump block 132 preferably having substantially the same cross-sectional perimeter as the portion of larger cross-sectional area 136 so that a pumping action is effected in the transitionary area 138 through the ports 140 generally in the manner described above with respect to FIGS. 1 and 2 (see FIGS. 19 and 20).

Additional alternate forms of the invention are illustrated in FIGS. 21 through 23. In FIG. 21, a plurality of regularly spaced, conically-shaped substantially nondeformable annular elements 142 are pivotally mounted on a disc 144, such as by means of forwardly projecting posts 146. The disc 144 is rotatably driven to convey the elements 142 through a passageway 148 in a circular pumping block 150 having a portion of larger cross-sectional area 152, a portion of smaller cross-sectional area 154, and a transitionary area 156 therebetween.

The posts 146 have rounded ends 158 proportioned to be matingly received in rounded pocket recesses on the inside of head ends 160 of the elements 142, and project along lines generally tangent to and spaced outwardly from, an outer circumferential edge 162 of the disc 144. The manner in which the elements 142 are supported permits displacement of the body of the elements 142 relative to the posts 146 in a pivoting fashion radially of the posts 146, while the head ends 160 are maintained at a substantially fixed radial distance from the center of the disc 144.

As can be seen in FIG. 21, the portion of smaller cross-sectional area 154 of the passageway 148 is located closer to the center of rotation of the disc 144 than the portion of larger cross-sectional area 152. Also, as shown in FIG. 22 the portion of smaller cross-sectional area 154 has an elliptical configuration in cross section which is a preferred means of achieving reduced cross section in the passageway 148. Further, the elements 142 and block 150 are constructed of a substantially nondeformable material, the proportions of each and properties of the materials being selected to insure essentially sealing engagement of the elements 142 with the passageway 148 as they are conveyed therethrough.

According to the preferred configuration of this embodiment, a pumping action is effected through outlet ports 164 located adjacent the transitionary area 156 when the elements 142 are conveyed through the passageway 148. As is shown, the elements 142 move through the portion of larger cross-sectional area 152 generally centrally located about the posts 146. That is, lines passing through both the axial centers or centroids of rear sealing edges 166 of the elements 142 and centers of the head ends 160 thereof are generally parallel to lines tangent to the path of rotation of the disc 144 adjacent the locations of the elements 142 in the passageway 148. When the elements 142 begin movement through the transitionary area 156, they pivot on the heads 158 of the posts radially inwardly towards the center of the disc 144. This shifts the centroids of the rear sealing edges 166 of the elements 142 inwardly decreasing the tangential velocity and cross-sectional area of an element which has transversed the transitionary area 156 relative to the adjacent element approaching the area 156. The effect of this is to produce an increase in the pressure of a fluid section captured between elements ahead of and behind the transitionary area 156 which causes fluid to be pumped.

As seen in FIGS. 21 and 22, the sealing edges 166 of the elements 142 are maintained in sealing engagement with the wall of the passageway 148 throughout traversal of the elements 142 through the passageway. This relationship is maintained when the elements 142 pivot on the posts 146 since the projection of the elements 142 corresponds to the projection of the passageway 148 at any location in the passageway 148, when viewed along a line passing through the center of the passageway 148 and tangent thereto at such location. Thus, the circular edges 166 appear as ellipses looking into the passageway 148 in the portion of reduced cross-sectional area 154 and assume this configuration while moving through the transitionary area 156, all the while maintaining essentially sealing engagement with the wall of the passageway 148. To facilitate this, the distance at which the head ends 160 of the elements 142 are maintained from the edge 162 of the disc 144 is selected so that when the elements 142 are fully pivoted, the heads 160 are just inside of the radially outermost wall surface of the passageway 148 in the portion of smaller cross-sectional area 154, but do not contact the wall surface.

A fluid sealing means 170 is provided to prevent fluid from entering or escaping from the passageway 148. The open area in the curved pumping block 150 is provided for causing fluid to be drawn into the passageway 148, which essentially functions as a reversal of the transitionary area 156 described above.

Of the alternate forms which the element 142 may take, there is shown in FIG. 23 an element 172 having a spherical configuration for use with a pumping block such as the one shown in FIG. 21, except for the modification of a passageway with a substantially constant circular cross section. The elements 172 are pivotally connected to arms 174 projecting from the circumferential edge of a disc 176. The passageway of the block has portions of different effective radii, as does the block 150 of FIG. 1. The pumping action is effected through the differences in tangential velocities of the elements 172 when they pivot on the arms 174 as they are conveyed through the portions of different radii in substantially the same manner as the conical elements 142.

The present embodiments of the invention herein described in the specification and shown in the drawings are only illustrative. Many further modifications to the form and types of annular elements which may be perimetally deformed rather than circumferentially compressed are possible, and these elements may be useful in applications other than pumps and metering devices as described. These further modifications will undoubtedly be supported by new materials of construction, including composite materials, and new requirements for measuring, handling and sealing fluids. Accordingly, although particular embodiments of the present invention have been described in the foregoing detailed description, it will be understood that the apparatus is capable of numerous rearrangements, modifications and substitutions of parts or materials without departing from the scope of the invention as set forth in the claims below.

What is claimed:

1. An apparatus for pumping fluids, comprising:

a pump block having a wall surface defining an elongated passageway, said wall surface further defining in said passageway a portion of smaller cross-sectional area, a portion of larger cross-sectional area, and a transitionary area therebetween, at least a portion of said wall surface being deformable whereby deformation of said wall surface changes the cross-sectional area of said passageway while the cross-sectional perimeter of said passageway remains substantially constant;

a port in said block for providing fluid flow communication with said passageway adjacent said transitionary area;

a plurality of spaced apart annular elements movable in said passageway;

means for interconnecting said spaced apart annular elements and for moving said elements in said passageway; and each of said spaced apart annular elements having a deformable peripheral skirt which is dimensioned to sealingly engage said wall surface defining said passageway so that a section of fluid can be isolated in the space between successive elements when said elements move through said passageway, whereby movement of said elements through said transitionary area of said passageway deforms the peripheral skirt of said elements to the shape of said wall surface, causing the pressure of a fluid section positioned adjacent said transitionary area to change effecting a pumping action through said port.

2. An apparatus for pumping fluids, comprising:

a pump block having a wall surface defining an elongated passageway with inlet and outlet open ends, said passageway having a substantially constant cross-sectional perimeter from said inlet to said outlet end;

a port spaced from one end of said passageway for providing fluid flow communication with said passageway;

a plurality of spaced-apart annular elements movable in said passageway, each of said annular elements having a generally conical wall, at least a portion of which sealingly engages said wall surface to isolate fluid sections between successive elements moving in said passageway, and having a hollow portion enclosed radially by said conical wall and open at a rearward end of each of said elements;

a continuous member for interconnecting said spaced-apart annular elements and for moving said annular elements through said passageaway;

means for changing the pressure within said passageway adjacent said part when said continuous member and annular elements are moving in said passageway with fluid sections isolated between successive elements so that a pumping action is effected through said port; and first and second sheaves for supporting said continuous member and attached annular elements for continuous movement through said passageway of said pump block, one of said sheaves being driven by a drive means inducing rotation of said sheave to impart a force causing movement of said annular elements and continuous member through said passageway, each of said sheaves having spaced apart recessed portions for supporting said annular elements on said sheave so that said continuous member leads onto and pays off of said sheaves at a substantially constant radius to move said annular elements through said passageway at a substantially constant linear velocity.

3. In an apparatus for pumping fluid which includes wall means defining an elongate passageway, a plurality of interconnected, spaced-apart annular elements longitudinally movable in the passageway to effect pumping, and means for moving the elements longitudinally in the passageway, the improvement which comprises:

said passageway having a substantially circular configuration to define a substantially circular path of movement of said elements and having sections of different radii and at least one section of changing radii intermediate said sections of different radii;

a port in said wall means adjacent said at least one section of changing radii; and said annular elements being substantially nondeformable and having peripheral surfaces sealingly engaging the wall means defining said passageway to isolate fluid sections between adjacent elements in said passageway, whereby moving said elements in said passageway through said at least one section of changing radii changes the tangential velocity of said elements to change the pressure in fluid sections adjacent said section of changing radii and effect a pumping action through said port.

4. An apparatus for pumping fluids, comprising:

a pump block having a wall surface defining an elongated passageway, said wall surface further defining in said passageway a portion of smaller cross-sectional area having a noncircular configuration in cross section, a portion of larger cross-sectional area, and a transitionary area therebetween;

a port in said block for providing fluid flow communication with said passageway adjacent said transitionary area;

a plurality of spaced apart annular elements movable in said passageway;

means for interconnecting said spaced apart annular elements and for moving said elements in said passageway; and each of said spaced apart annular elements having a deformable peripheral skirt which is dimensioned to sealingly engage said wall surface defining said passageway so that a section of fluid can be isolated in the space between successive elements when said elements move through said passageway, whereby movement of said elements through said transitionary area of said passageway deforms the peripheral skirt of said elements to the shape of said wall surface, causing the pressure of a fluid section positioned adjacent said transitionary area to change effecting a pump action through said port.

5. The apparatus of claim 1, wherein each of said annular elements comprises a generally conical wall with its smaller end being attached to said means for interconnecting, and its larger end being spaced longitudinally from said smaller end, said smaller end generally being the forward end generally and said larger end being the rearward end as said element is moved in said passageway with at least a portion of said conical wall sealingly engaging said wall surface defining said passageway.

6. The apparatus of claim 5, wherein said rearward end of each of said conical walls has a rearward edge spaced rearwardly of said forward end with the perimeter of said edge being substantially the same distance from said forward end at all points along said edge, whereby said elements, when deformed by passage through said transitionary area of said passageway, has substantially the same perimetal dimension along said edge as before deformation of said element.

7. The apparatus of claim 6, wherein each of said elements further comprises a hollow portion open at said rearward end, said hollow portion being enclosed radially by an inner surface of said conical wall.

8. The apparatus of claim 4, wherein said portion of larger cross-sectional area is circular in cross-section and said portion of smaller cross-sectional area is generally elliptical in cross section.

9. The apparatus of claim 6, wherein said rearward edge sealingly engages said wall defining said passageway as said element moves in said passageway.

10. The apparatus of claim 5, wherein said rearward end of each of said elements has a rearward edge spaced rearwardly of said forward end, said conical wall of said element between said forward and rearward edge being formed in the shape of a surface of revolution of the involute of a circle with the surface of revolution having a radially outermost peripheral contact surface sealingly engaging said wall defining said passageway.

11. In an apparatus for pumping fluids, which includes wall means defining an elongated passageway of varying cross section and a plurality of spaced apart elements movable in said passageway to effect pumping, the improvement which comprises providing in said passageway a section of smaller cross-sectional area having a substantially noncircular cross section, a section of larger cross-sectional area adjacent said section of smaller cross-sectional area and a transitionary section of changing cross section therebetween, and employing annular elements having a peripheral skirt which is dimensioned to sealingly engage the wall means defining said passageway.

12. The apparatus of claim 11, wherein said peripheral skirt is provided at the trailing end of said element as it moves in said passageway.

13. The apparatus of claim 12, wherein said peripheral skirt is deformable as it passes through the varying cross section of the passageway.

14. The apparatus of claim 13, wherein said peripheral skirt is of generally conical shape.

15. The apparatus of claim 13, wherein the trailing end of said element is formed in the shape of a surface of revolution of the involute of a circle of revolution a portion of which sealingly engages the wall means defining the passageway.

* * * * *

UNITED STATES PATENT AND TRADEMARK OFFICE

CERTIFICATE OF CORRECTION

PATENT NO. : 4,738,598

DATED : April 19, 1988

INVENTOR(S) : Alden A. Lofquist, Jr.

It is certified that error appears in the above-identified patent and that said Letters Patent is hereby corrected as shown below:

Claim 2, Column 11, line 21, delete "part" and substitute --port--.

Claim 5, Column 12, line 28, delete "generally".

Claim 5, Column 12, line 28, after "larger end" insert --generally--.

Signed and Sealed this

Twentieth Day of December, 1988

*Attest:*

DONALD J. QUIGG

*Attesting Officer*

*Commissioner of Patents and Trademarks*